US005090883A

United States Patent [19]

Krauter et al.

[11] Patent Number: 5,090,883

[45] Date of Patent: Feb. 25, 1992

[54] FUEL SUPPLY ASSEMBLY FOR A MOTOR VEHICLE

[75] Inventors: Lothar Krauter, Bietigheim-Bissingen; Hermann Nusser, Markgröningen; Peter Schelhas; Rainer Schillinger, both of Stuttgart; Dietrich Trachte, Leonberg; Ulrich Kemmner, Stuttgart, all of Fed. Rep. of Germany

[73] Assignee: Robert Bosch GmbH, Stuttgart, Fed. Rep. of Germany

[21] Appl. No.: 644,215

[22] Filed: Jan. 22, 1991

Related U.S. Application Data

[62] Division of Ser. No. 463,231, Jan. 10, 1990, abandoned.

[30] Foreign Application Priority Data

Apr. 20, 1989 [DE] Fed. Rep. of Germany ..... 3912965

[51] Int. Cl.[5] ..... F04C 2/10

[52] U.S. Cl. ..... 418/171

[58] Field of Search ..... 418/164, 166, 168, 170, 418/171, 172

[56] References Cited

U.S. PATENT DOCUMENTS

| | | | |
|---|---|---|---|
| 3,512,906 | 5/1970 | Molly | 418/170 |
| 3,676,027 | 7/1972 | Molly | 418/170 |
| 3,954,355 | 5/1976 | Paul, Jr. | 418/164 |
| 4,013,388 | 3/1977 | Stratman | 418/171 |
| 4,401,416 | 8/1983 | Tuckey | 417/283 |
| 4,820,138 | 4/1989 | Bollinger | 418/171 |

FOREIGN PATENT DOCUMENTS

| | | | |
|---|---|---|---|
| 3105547 | 1/1982 | Fed. Rep. of Germany . | |
| 63-223380 | 9/1988 | Japan | 418/171 |

*Primary Examiner*—Richard A. Bertsch
*Assistant Examiner*—David L. Cavanaugh
*Attorney, Agent, or Firm*—Michael J. Striker

[57] ABSTRACT

A fuel supply assembly for feeding fuel to an internal combustion engine and comprising a gear pump that includes a ring gear having inner teeth, and a pinion arranged eccentrically with respect to said ring gear and having outer teeth meshing with the inner teeth of the ring gear and defining therewith expanding and contracting chambers during operation of the pump, the pump further including an outer support element for movably supporting the ring gear and including a supporting surface which engages a portion of the outer surface of the ring gear and is located radially outside of a discharge opening of the pump.

1 Claim, 2 Drawing Sheets

FUEL SUPPLY ASSEMBLY FOR A MOTOR VEHICLE

RELATED APPLICATIONS

This application is a division of application Ser. No. 463,231, filed Jan. 10, 1990, now abandoned.

BACKGROUND OF THE INVENTION

The invention relates to a fuel supply assembly and more specifically to a positive displacement pump for a fuel supply assembly and formed as an internal gear pump comprising a ring gear having internal teeth that cooperate with external teeth of a pinion to form expanding and contracting pumping chambers, and outer support means for supporting the ring gear. Such an assembly is disclosed in DE-OS 3,105,547 corresponding to U.S. Pat. No. 4,401,416. In the assembly disclosed therein, the outer support means comprises circular guide plate for guiding the ring gear. The inner surface of the circular guide plate defining its bore slidably engages the ring gear so that the ring gear rotates without any play. The tolerances should be so selected that the ring gear of the gear pump is not damaged. This would require very close tolerances which can be obtained only by high precision finishing operations which substantially increase the costs of manufacturing the pump.

SUMMARY OF THE INVENTION

The object of the invention is a fuel supply assembly that includes a gear pump the costs of manufacture of which are reduced. The object of the invention is achieved by providing a gear pump in which the outer support member is mounted eccentrically with respect to the ring gear and in such a manner that the supporting surface of the support member engages only a portion of the outer surface of the ring gear in a region located radially outside of the discharge opening of the gear pump.

It was found that a ring gear of a gear pump during operation of the pump is loaded in a rather precisely determined direction by a force which is a resulting force of a plurality of external forces acting on the ring gear. This plurality of forces includes a driving force, friction forces at points of support and contact of the ring gear with the driving element, a pressure force, and a bearing force. The resulting force acts in a region that is located radially outside of the discharge opening of the pump. Therefore, it is sufficient to support the ring gear only in this region for properly guiding the ring gear in its movement.

Providing outer support means having a supporting surface that engages only a portion of the outer surface of the ring gear in the region of action of the resulting force permitted to eliminate costly finishing operations.

The present invention both as to its construction so to its mode of operation, together with additional objects and advantages thereof, will be best understood from the following detailed description of specific embodiments when read in connection with the accompanying drawings.

DETAILED DESCRIPTION OF PREFERRED EMBODIMENTS

Figure 1:
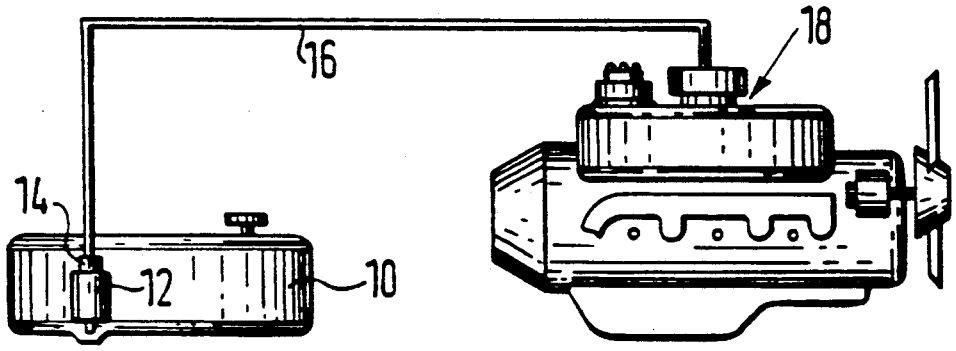
FIG. 1 shows a general view of a fuel supply system for a motor vehicle and including a fuel supply assembly arranged in a fuel storage tank.

A motor vehicle fuel supply system shown in FIG. 1 includes a fuel storage tank 10 in which a fuel supply assembly is arranged. A pressure conduit 16 extends from a pressure nipple 14 of the fuel supply assembly 12 to an internal combustion engine 18. The fuel supply assembly 12 delivers fuel from the fuel storage tank 10 to the internal combustion engine 1 during operation of the latter.

Figure 2:
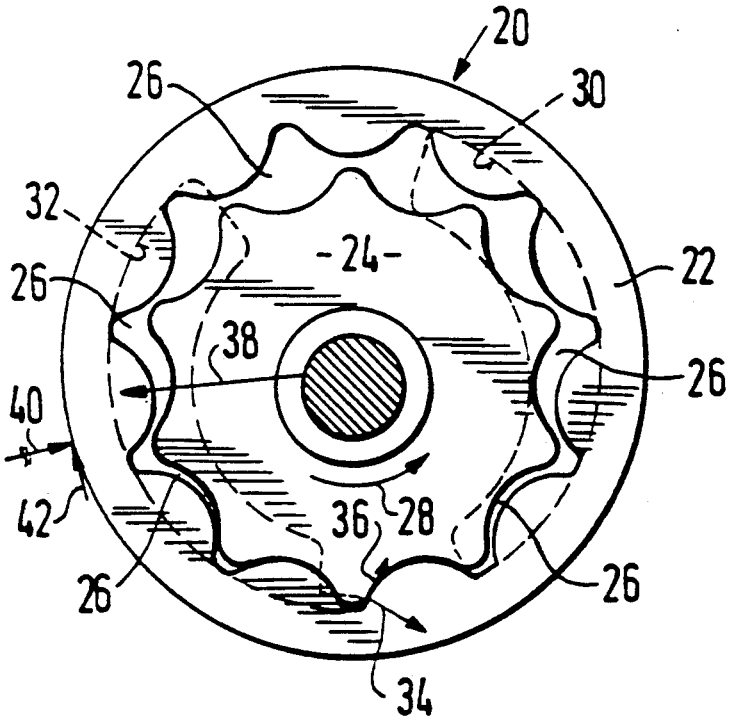
FIG. 2 shows a plan view of an internal gear pump of the fuel supply assembly with indication of external forces acting on the gear ring.

The fuel supply assembly 12 comprises an internal gear pump 20 functioning as a positive displacement pump. The pump 20 includes a ring gear 22 with inner teeth and a pinion 24 with outer teeth. The pinion 24 has fewer teeth than the ring gear 22 and is arranged eccentrically with respect to the ring gear 22 so that the teeth of the pinion 24 engage those of the ring gear 22. The teeth of the ring gear 22 and the pinion 24 during operation of the internal gear pump 20, define expanding and contracting chambers that provide for pumping of the supply fuel. The direction of rotation of the pinion 24 is shown with arrow 28. Of course, the ring gear 22 is rotatable in the same direction. In the region of expanding chambers 26, there is provided a crescent-shaped inlet opening 30, shown in dash lines, through which the supply medium is admitted in the pumping chambers 26. In the region of contracting pumping chambers 26, there is provided a likewise crescent-shaped outlet opening 32, also shown in dash lines. Both openings 30 and 32 are shown in FIG. 2 in a simplified form. The openings are provided in cover plates 29 and 37 which limit the pumping chambers 26 in an axial direction. The inner ring gear 22 requires, of course, a stationary guide so that its position with respect to the pinion 24 would not change during operation of the positive displacement pump. This feature will be discussed in more detail below. It can be seen in FIG. 2 that during pump operation, different external forces act on the ring gear 22. These forces include a driving force (arrow 36), a pressure force (arrow 38), a bearing force (arrow 40), and a friction force in the support (arrow 42).

Figure 3:
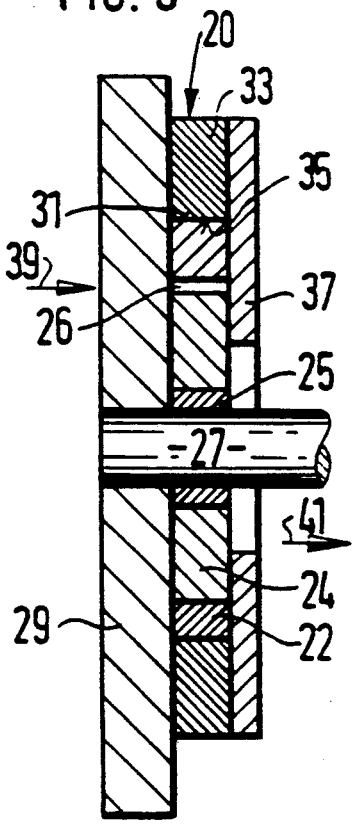
FIG. 3 shows a longitudinal sectional view of an internal gear pump shown in FIG. 2.

FIG. 3 shows a longitudinal cross-sectional view of a pump shown in FIG. 2. The pinion 24 is rotatably supported on a guide pin 27 by a bearing bush 25. The guide pin 27 is fixed in the suction or cover plate 29. As shown in FIG. 3, the outer surface 31 of the ring gear 22 is surrounded by a guide ring 33 the wall 35 of which defines a guiding or seat surface for the outer surface 31 of the ring gear 22. A second cover or pressure plate 37 is provided on a side of the guide ring 33 opposite from the suction plate 29. The plates 29 and 37, as it has already been discussed before, axially limit the pumping chambers 26 formed by teeth of the ring gear 22 and pinion 24. The inlet or suction opening 30 and the outlet or discharge opening 32 are formed in one of the two cover plates 29 and 37. As the arrangement of openings 30 and 32 is unimportant in the structure described so far, they are not shown in FIG. 3. It should only be indicated that the supply medium enters the pump in a direction of arrow 39 and leaves it in a direction of arrow 41.

Figure 4:
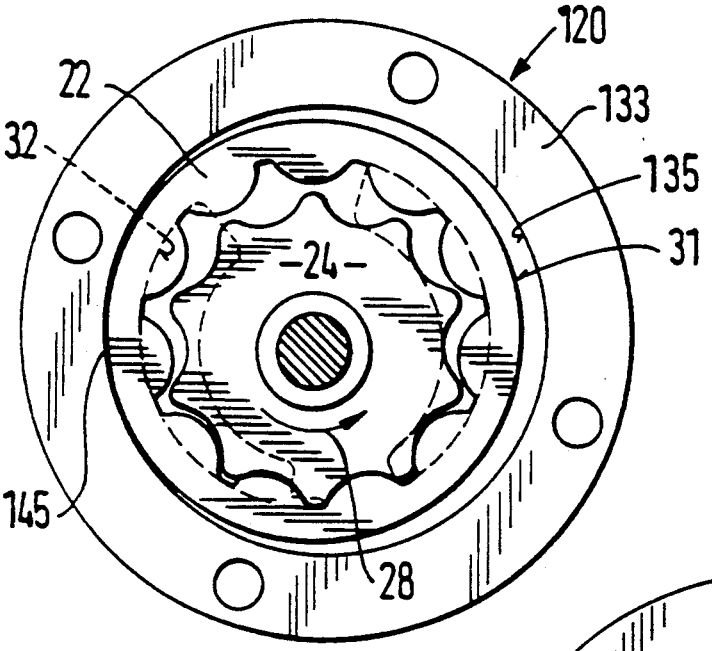
FIG. 4 shows a plan view of a first embodiment of a fuel supply assembly according to the present invention.

In FIG. 4 showing a first embodiment of a fuel supply assembly according to the invention, the construction of the positive displacement pump 120 is similar to that of pump 20. The difference between the two pumps consists in that the inner diameter of the guide ring 133 in the assembly according to the present invention is larger than the diameter of the outer surface 31 of the ring gear 22. The guide ring 33 is arranged eccentrically with respect to the ring gear 22 whereby a support surface 145 is located radially outside of the discharge opening 32. The support surface 145 represents a contact surface between the outer surface 31 of the ring gear 22 and the inner wall 135 of the support ring. It may be said that the contact surface 145 possibly extends against a line of action of a resulting force of the external forces acting on the ring gear 22.

Figure 5:
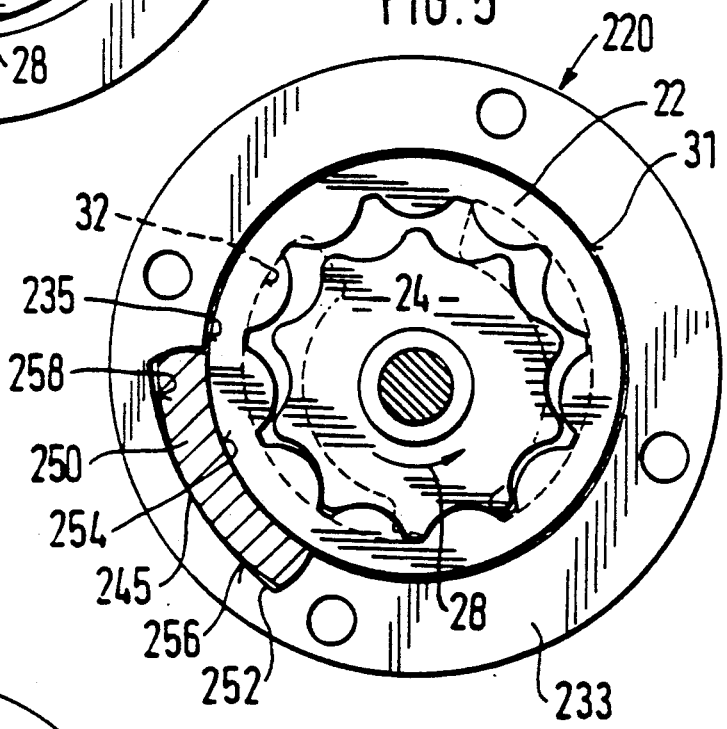
FIG. 5 shows a plan view of a second embodiment of a fuel supply assembly according to the present invention.

The embodiment of a fuel supply assembly shown in FIG. 5 corresponds to that shown in FIG. 4. Here also, the ring gear 22 is surrounded by a support ring 233 the inner diameter of which is larger than the diameter of the outer surface 31 of the gear ring 22. Radially outside of the discharge opening 32, the support ring 133 is provided with a segment insert 250 located in a recess 252 which opens into the bore of the ring 233. The insert 250 projects beyond the inner surface 235 of the support ring 233. The surface 254 of the insert 250 which is adjacent to the outer surface 31 of the ring gear 22, has the same radius that the outer surface 31 has. The surface 254 forms a support or guide seat for the ring gear 22. The insert 250 on a side thereof which is opposite to the surface 254, has a curved surface 256 that engages a surface 258 of the support ring 233. The insert 250 is formed as a rocker. As it can be seen in FIG. 5, the curvature of the surface 258 is less than that of the surface 256 of the insert 250. Thereby, the insert 250 is able to balance the support ring 233 as the insert 250 adjusts its position in accordance with the resulting force acting on the ring gear 22. The insert 250 engages a support surface 245 of the support ring 233. The support surface 245 is located radially outside of the discharge opening 32.

Figure 6:
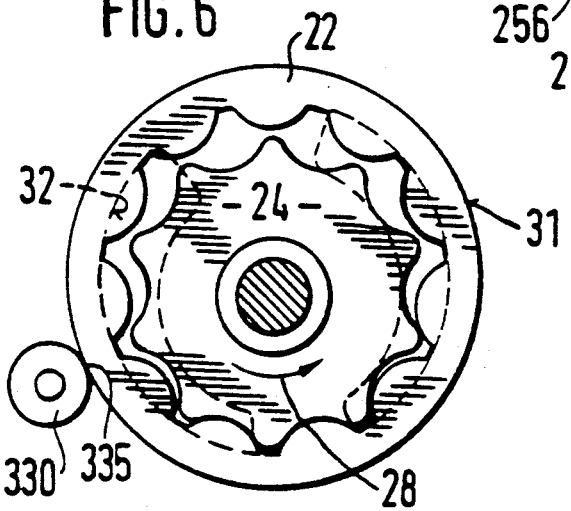
FIG. 6 shows a plan view of a third embodiment of a fuel supply assembly according to the present invention.

In the embodiment shown in FIG. 6, the ring gear 22 is supported by a stationary roller 330 located radially outside of the discharge opening 32. The ring gear 22 is supported along a line 335 extending parallel to the axes of rotation of the ring gear 22 and the pinion 24. In this embodiment, it is important that support and guiding of the ring gear 22 is effected without any significant friction forces.

It is common for all embodiments that the counter-support 145, 245, 345 is provided on a portion of a respective support element 133, 250, 233, or 330 that engages the outer surface 31 of the ring gear 22, and is located radially outside of the discharge opening 32.

While the invention has been illustrated and described as embodied in a fuel supply assembly for a motor vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A gear pump for a fuel supply assembly that feeds fuel from a fuel storage tank to an internal combustion engine of a motor vehicle, said gear pump comprising a ring gear having internal teeth; a pinion having external teeth meshing with said internal teeth of said ring gear, said pinion having less teeth than said ring gear, said internal teeth of said ring gear and said external teeth of said pinion defining expanding and contracting pumping chambers when said gear pump is driven; two cover plates for axially limiting said pumping chambers and having a suction opening in a region of expanding pumping chambers and a discharge opening in a region of contracting pumping chambers; and stationary outer support means for movably supporting said ring gear, said outer support means comprising a support roller having an axis extending substantially parallel to an axis of said gear pump and a supporting surface engaging a portion of an outer surface of said ring gear and arranged outside of said discharge opening.

* * * * *